US011619374B1

(12) United States Patent
Lai

(10) Patent No.: US 11,619,374 B1
(45) Date of Patent: Apr. 4, 2023

(54) STYLING ILLUMINATION SET AND ILLUMINATION DEVICE

(71) Applicant: Peng Hsiang Lai, New Taipei (TW)

(72) Inventor: Peng Hsiang Lai, New Taipei (TW)

( * ) Notice: Subject to any disclaimer, the term of this patent is extended or adjusted under 35 U.S.C. 154(b) by 0 days.

(21) Appl. No.: 17/807,311

(22) Filed: Jun. 16, 2022

(51) Int. Cl.
*F21V 23/06* (2006.01)
*F21S 2/00* (2016.01)
*F21Y 107/20* (2016.01)

(52) U.S. Cl.
CPC ..... *F21V 23/06* (2013.01); *F21S 2/005* (2013.01); *F21Y 2107/20* (2016.08)

(58) Field of Classification Search
CPC ..... F21S 2/005; F21Y 2107/20
See application file for complete search history.

(56) References Cited

U.S. PATENT DOCUMENTS 8,371,894 B1 * 2/2013 Rosen ..... A63H 33/086 446/485
8,864,546 B1 * 10/2014 Capriola ..... A63H 33/042 446/124
10,359,164 B2 * 7/2019 Sozzi ..... F21V 19/0055
10,531,542 B2 * 1/2020 Rodinger ..... H05B 47/18
2009/0047863 A1 * 2/2009 Capriola ..... A63H 33/042 446/91
2009/0244871 A1 * 10/2009 Lin ..... H05K 1/142 361/791
2010/0197148 A1 * 8/2010 Rudisill ..... H01R 13/6205 439/40
2011/0141736 A1 * 6/2011 Lin ..... F21V 21/005 362/240
2013/0242615 A1 * 9/2013 Lin ..... F21V 23/06 362/640
2013/0258682 A1 * 10/2013 Pino ..... H01R 25/162 362/382
2016/0360584 A1 * 12/2016 Xie ..... H05B 45/37
2018/0320846 A1 * 11/2018 Sozzi ..... F21S 8/061

* cited by examiner

*Primary Examiner* — Evan P Dzierzynski
(74) *Attorney, Agent, or Firm* — Rosenberg, Klein & Lee

(57) ABSTRACT

A styling illumination set is provided. The styling illumination set has multiple illumination assemblies, multiple bendable connectors, and fixing components. Each illumination assembly has a bottom casing, a top cover, and a circuit board. The circuit board has multiple sockets. Each two of the illumination assemblies are connected by one of the bendable connectors via the sockets and fixed by one of the fixing components, and thereby an angle between the two illumination assemblies is secured. With the bendable connectors, which can be bent in any angle, the angle between the illumination assemblies can be changed as well. Therefore, the configurations of the assembled styling illumination set is capable of being built up in three dimensions.

16 Claims, 17 Drawing Sheets

STYLING ILLUMINATION SET AND ILLUMINATION DEVICE

BACKGROUND OF THE INVENTION

1. Field of the Invention

The present invention relates to an illumination device, especially to a mood lamp that is used for decoration or as a puzzle toy.

2. Description of the Prior Arts

Conventionally, mood lamps are disposed on a desk or a wall and are configured to illuminate or create atmosphere. The conventional mood lamps only have a monotonous usage and cannot be changed easily. Therefore, in recent years, mood lamps that can be combined together and overall controlled are provided. However, these mood lamps only can be combined in two dimensions as a plane surface. Moreover, these mood lamps have the following defects:

1. Illumination assembly of such mood lamp has many LEDs. Because of too many LEDs, the dimensions of the mood lamp are hard to be miniaturized, the cost of manufacture is high, and the control system is complicated.
2. Such mood lamps only can be combined together in two dimensions. In other words, such mood lamps cannot be combined in three dimensions.
3. Such mood lamp comprises USB type-A ports for connection. The dimensions of the type-A port are large, which is another factor that enlarges the dimensions of the entire mood lamp.

To overcome the shortcomings, the present invention provides a styling illumination set and an illumination device to mitigate or obviate the aforementioned problems.

SUMMARY OF THE INVENTION

The main objective of the present invention is to provide a styling illumination set and an illumination device that are capable of being assembled in three dimensions, which allows the present invention to be arranged in more unique configurations.

The styling illumination set has a plurality of illumination assemblies, a plurality of bendable connectors, and a plurality of fixing components. Each one of the illumination assemblies has a bottom casing, a top cover, a circuit board. The top cover is mounted on the bottom casing. The circuit board is mounted in the bottom casing and between the top cover and the bottom casing. The circuit board has an illumination component and a plurality of sockets. Adjacent two of the illumination assemblies are connected by one of the bendable connectors and fixed by one of the fixing components, and thereby an angle between the adjacent two illumination assemblies being secured.

The illumination device has an illumination assembly and a plurality of type-C female ports. The illumination assembly has a bottom casing, a top cover, and an illumination circuit board. The top cover is mounted on the bottom casing. The illumination circuit board is mounted in the bottom casing and between the top cover and the bottom casing. The female ports are mounted on a bottom surface of the illumination assembly and face laterally and outward. Wherein a plurality of the illumination devices are configured to be connected by a plurality of connectors, power and signals are transmitted between said illumination devices via the connectors, each one of the connectors including multiple male ports. said two illumination devices are fixed via a fixing component, said fixing component forms an angled shape such that two of said illumination devices are secured in a non-planar arrangement.

With bendable connectors, which can be bent in any angle, the angle between the illumination assemblies can be changed as well. Therefore, the configurations of the styling illumination set or the assembled illumination device are not restrained in two dimensions, but are capable of being built up in three dimensions, which allows the present invention to be arranged in more unique configurations. With the illumination assembly having female ports as sockets, the sizes of sockets are minimized, such that the size of the illumination assembly is also minimized.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
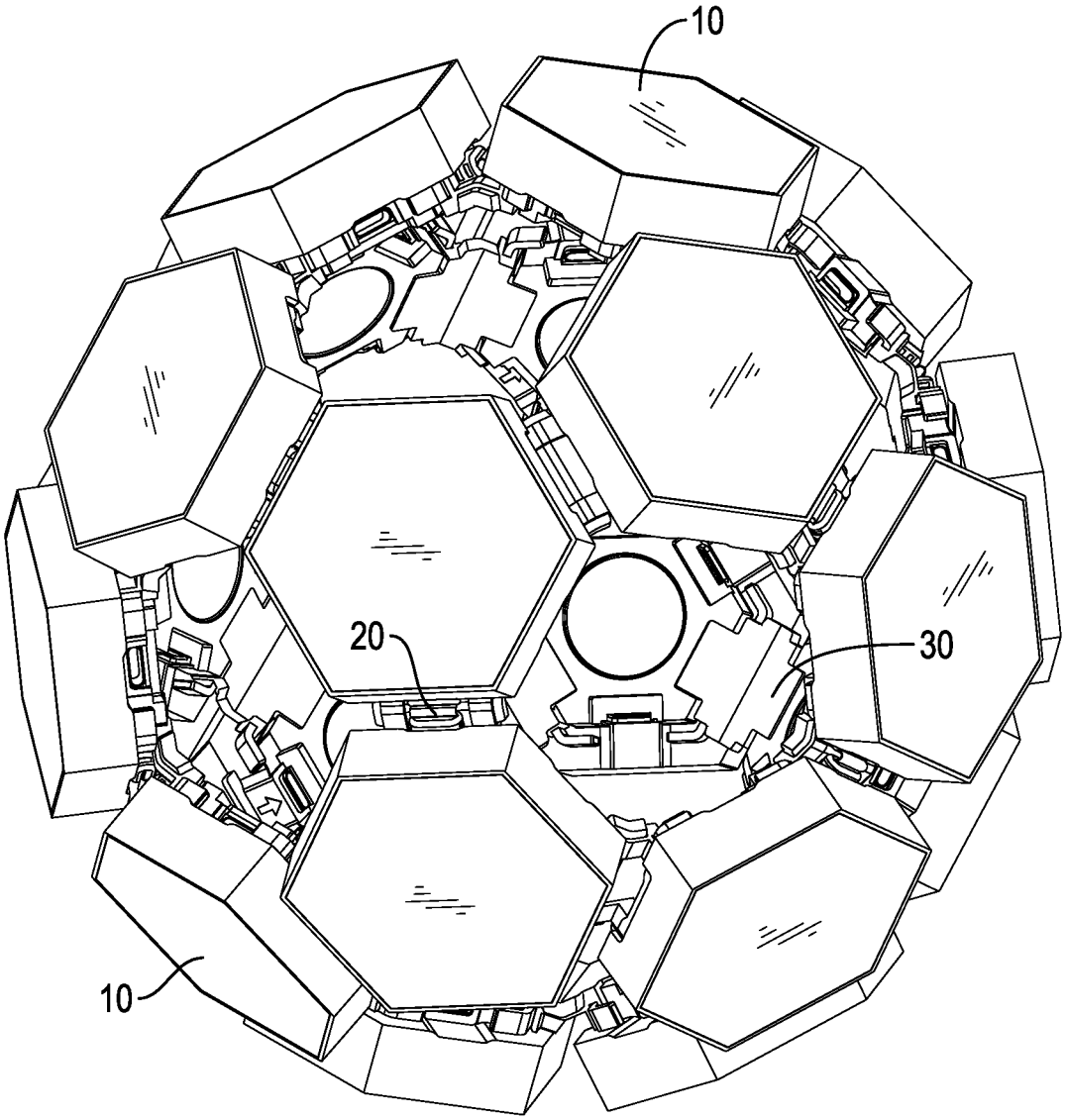
FIG. 1 is a perspective view of a styling illumination set in accordance with the present invention.
Figure 2:
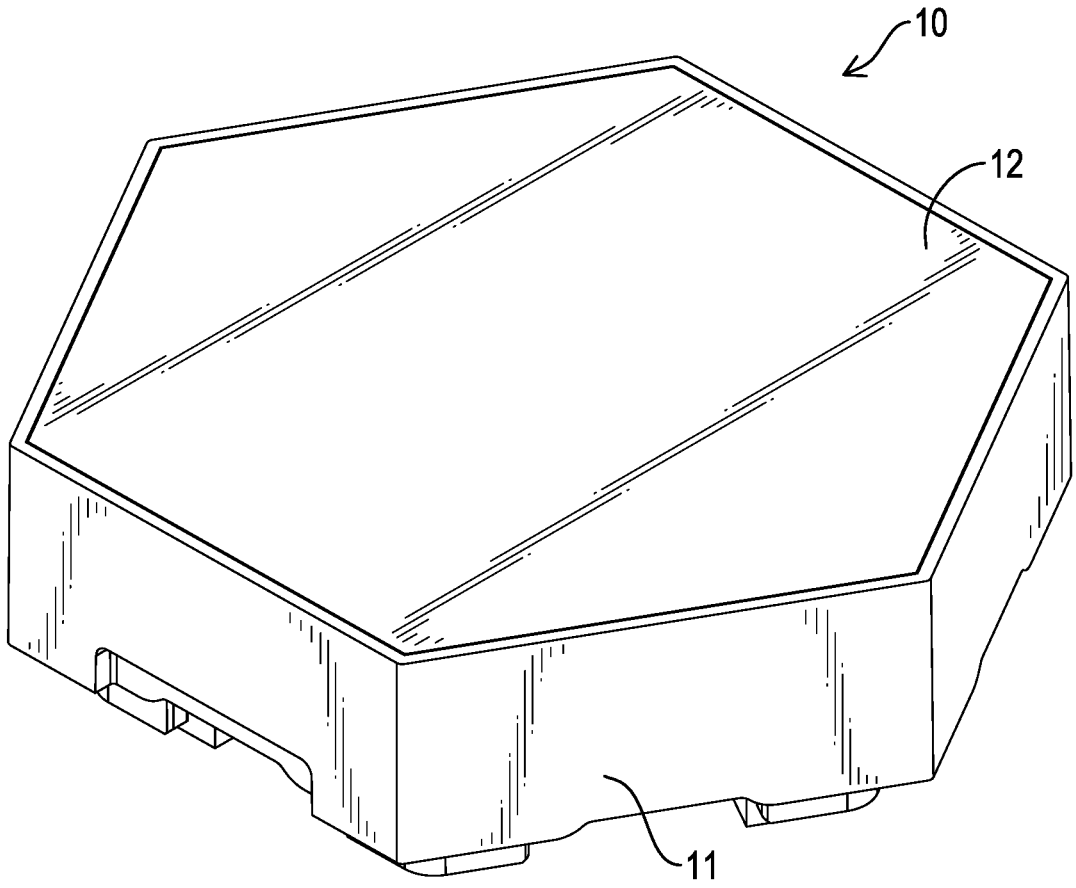
FIG. 2 is a perspective view of an illumination assembly of the styling illumination set in FIG. 1, which also is an illumination device in accordance with the present invention.
Figure 3:
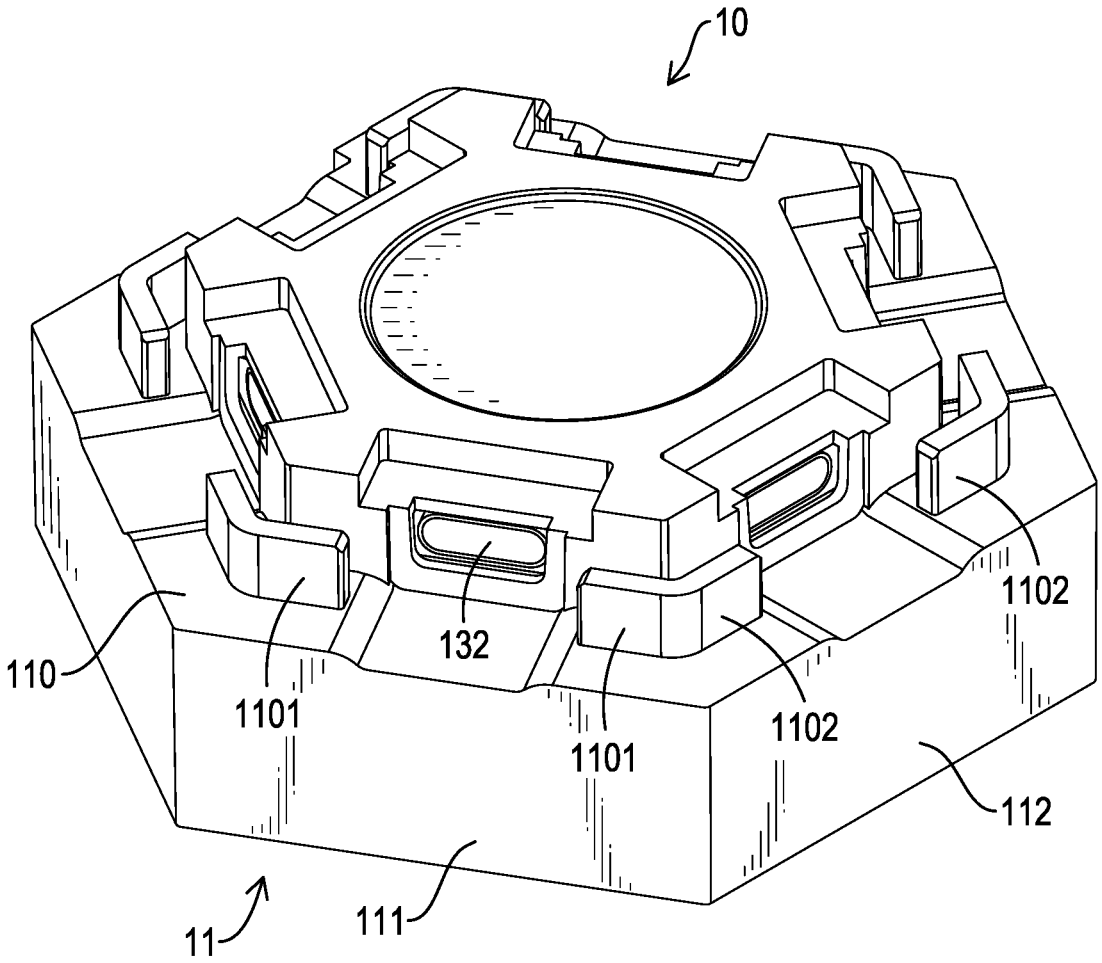
FIG. 3 is another perspective view of the illumination assembly in FIG. 2.
Figure 4:
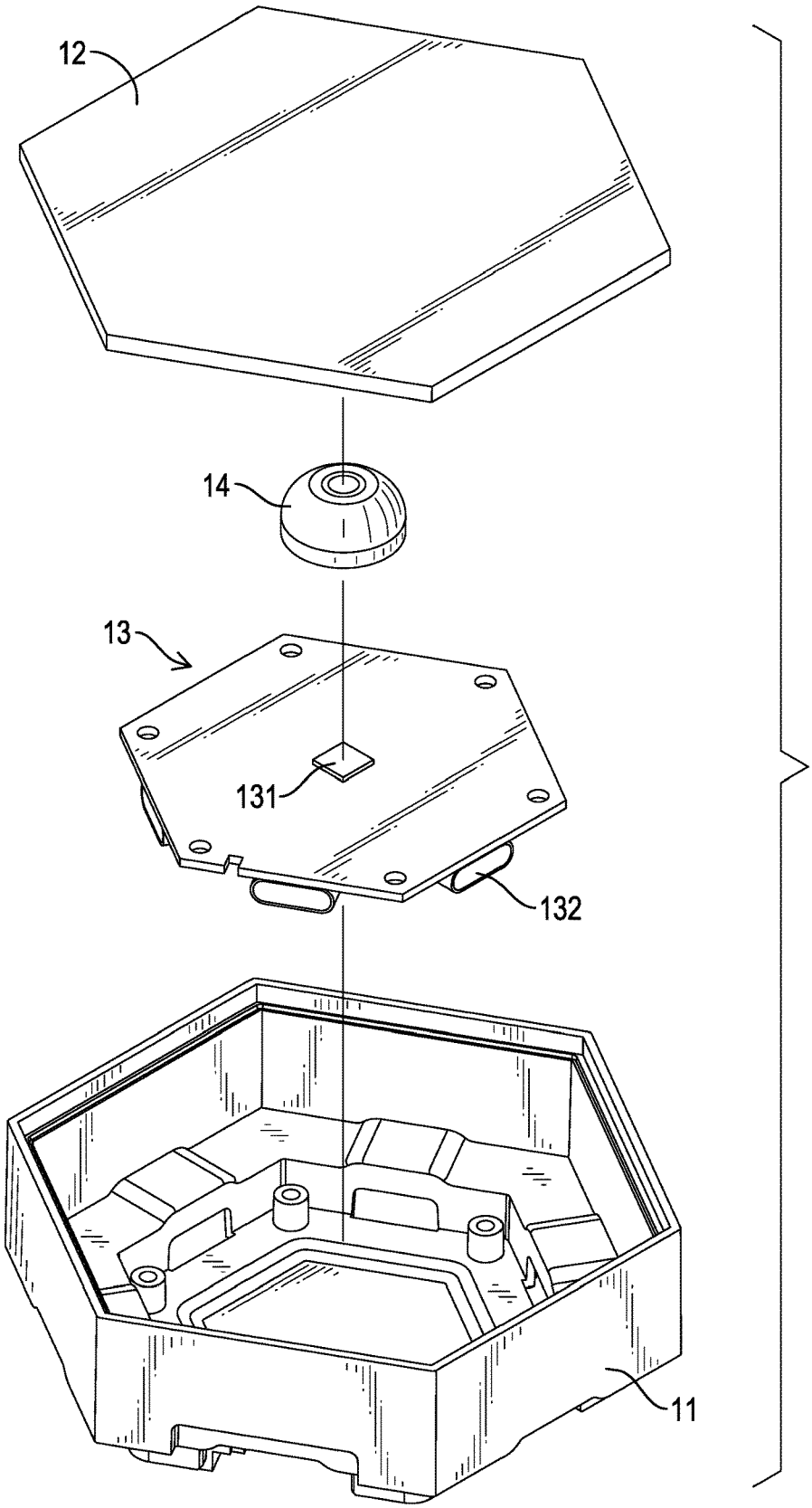
FIG. 4 is an exploded view of the illumination assembly in FIG. 2.
Figure 5:
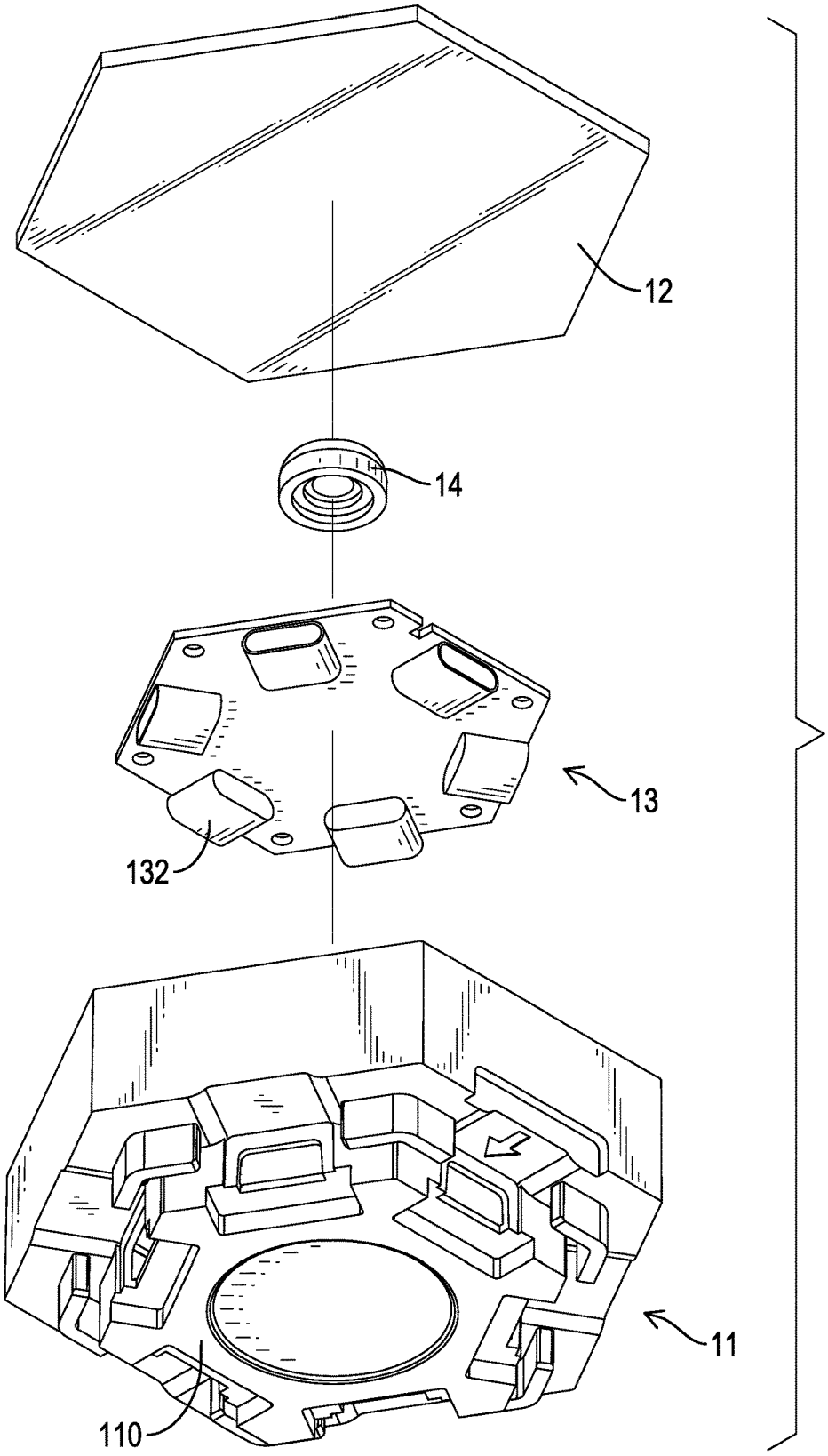
FIG. 5 is another exploded view of the illumination assembly in FIG. 2.
Figure 12:
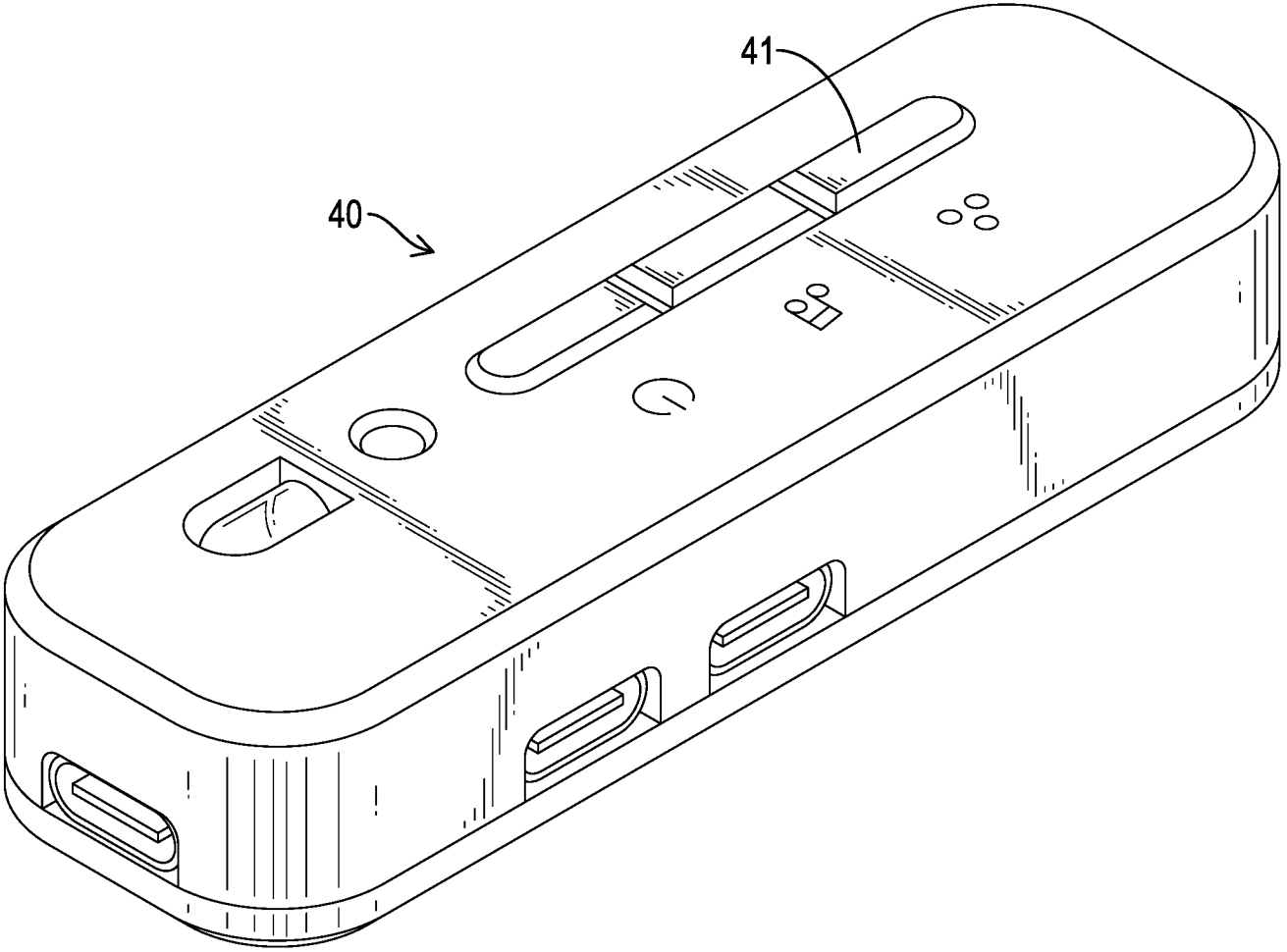
FIG. 12 is a perspective view of a controller of the styling illumination set in FIG. 1.
Figure 13:
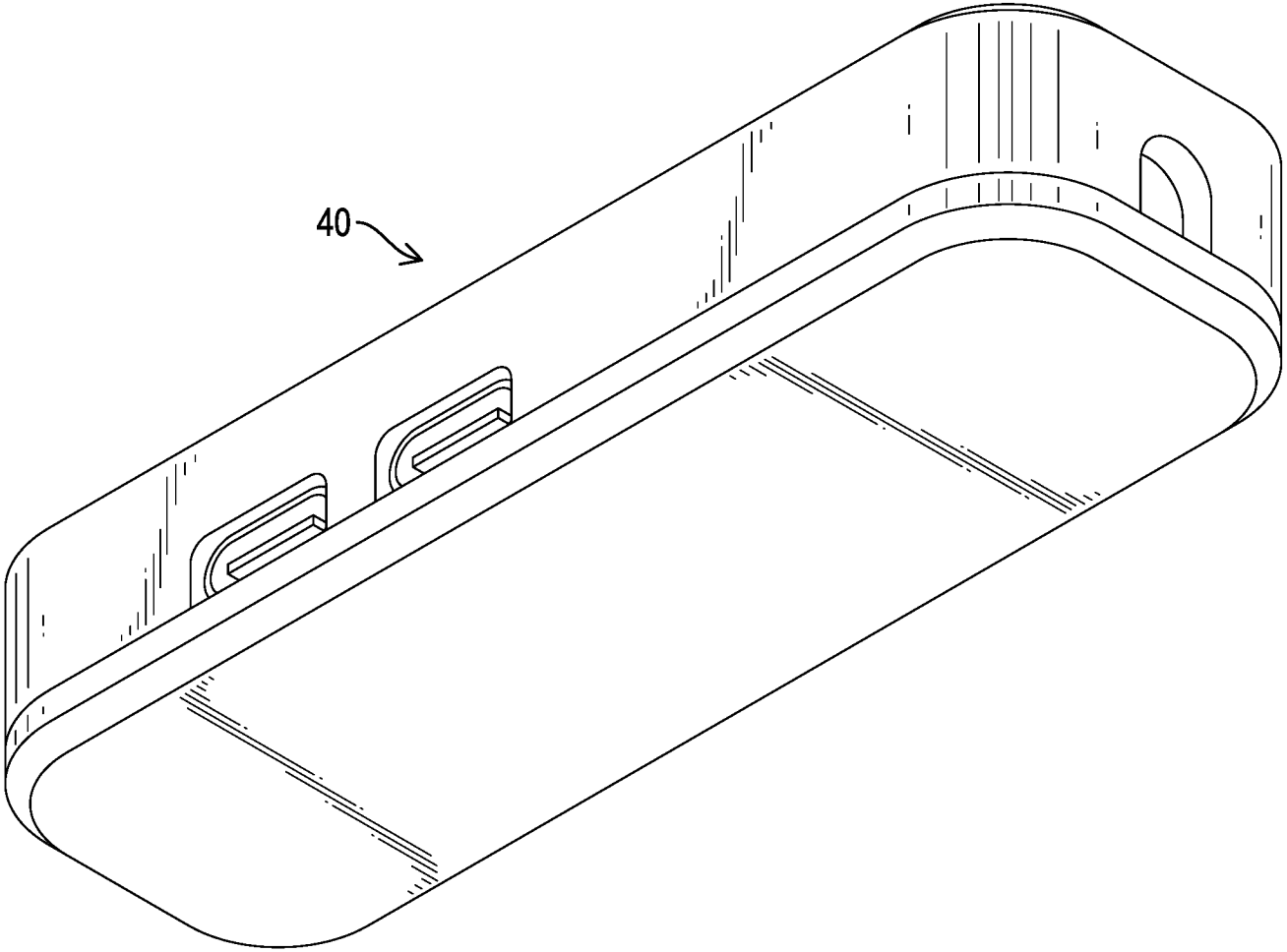
FIG. 13 is another perspective view of the controller in FIG. 12.
Figure 14:
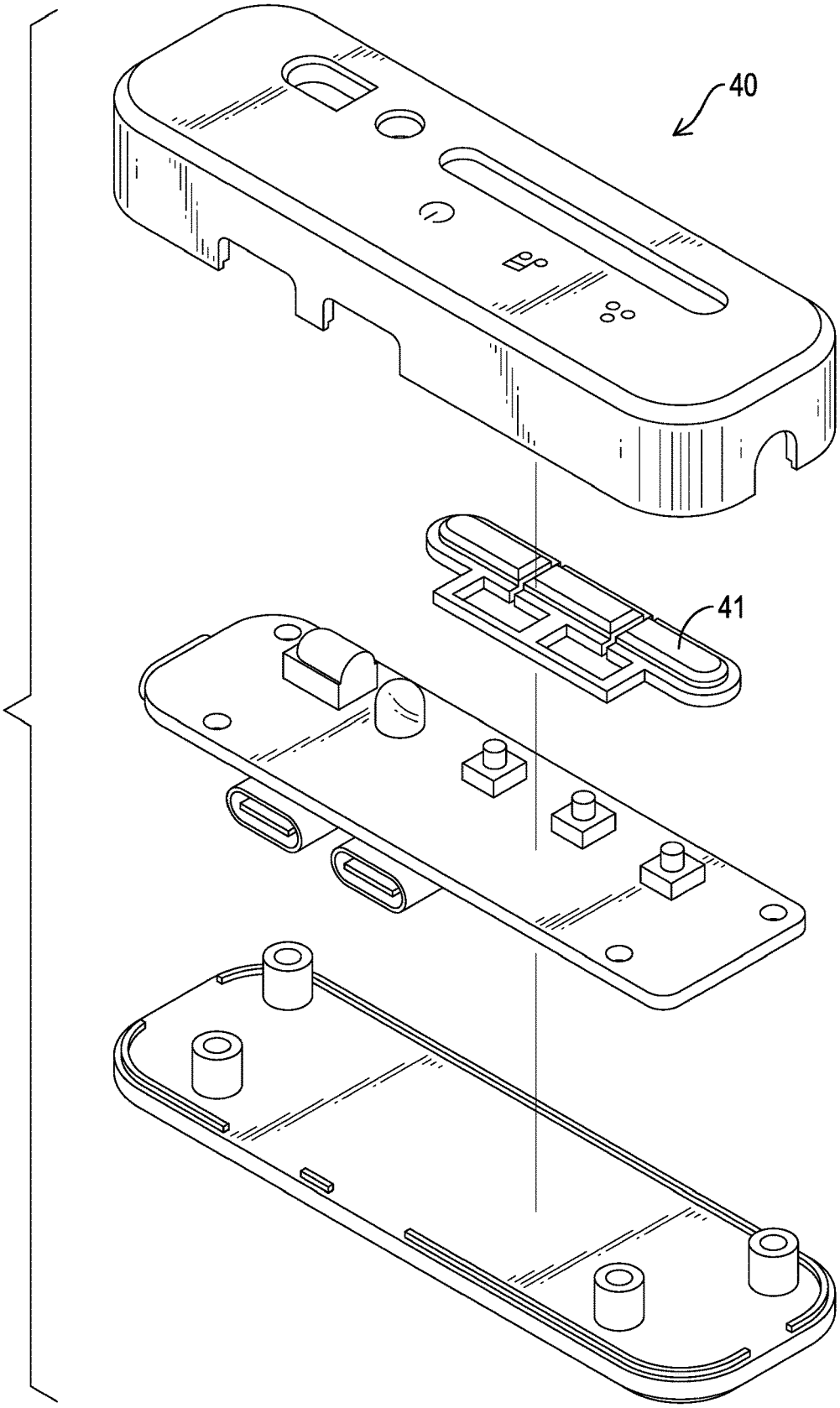
FIG. 14 is an exploded view of the controller in FIG. 12.

Please refer to FIG. 1 and FIG. 12. A styling illumination set is provided in accordance with the present invention. The styling illumination set comprises a plurality of illumination assemblies 10, a plurality of bendable connectors 20, and a plurality of fixing components 30. The styling illumination set may selectively have a controller 40.

Then please refer to FIG. 2 to FIG. 5. Each one of the illumination assemblies 10 comprises a bottom casing 11, a top cover 12, and a circuit board 13. In this embodiment, each illumination assembly 10 further comprises a divergent component 14.

The bottom casing 11 is a polygon and, preferably, is a triangle, quadrilateral, pentagon, hexagon, or octagon. Hereinafter, the bottom casing 11 is a hexagon in this embodiment. The bottom casing 11 comprises a bottom surface 110, a first lateral surface 111, a second lateral surface 112, and third to sixth lateral surfaces. The first lateral surface 111, the second lateral surface 112, and the third to sixth lateral surfaces surround the bottom surface 110. Besides, the bottom surface 110 is connected to the first lateral surface 111, the second lateral surface 112, and the third to sixth lateral surfaces; the first lateral surface 111 is further connected to the second lateral surface 112 and the sixth lateral surface; the second lateral surface 112 is further connected to the third lateral surface; and so forth. The number of the lateral surface(s) is not limited thereto.

The bottom casing 11 further comprises at least one first rib 1101, at least one second rib 1102, at least one third rib, at least one fourth rib, at least one fifth rib, and at least one sixth rib. The at least one first rib 1101 is mounted on the bottom surface 110 and adjacent to the first lateral surface 111, the at least one second rib 1102 is mounted on the bottom surface 110 and adjacent to the second lateral surface 112, and so forth.

Moreover, the at least one first rib 1101 extends in parallel with the first lateral surface 111, the at least one second rib 1102 extends in parallel with the second lateral surface 112, and so forth. Precisely, "the at least one first rib 1101 extends in parallel with the first lateral surface 111" means the dimension of the first rib 1101 that is parallel with the edge where the first lateral surface 111 is connected to the bottom surface 110 is larger than the dimension of the first rib 1101 that is perpendicular to the first lateral surface 111.

In this embodiment, the bottom casing 11 has two first ribs 1101, two second ribs 1102, and so forth. One of the two first ribs 1101 is connected to one of the two second ribs 1102 and the other one of the two first ribs 1101 is connected to one of the sixth ribs. Therefore, the connected first rib 1101 and second rib 1102 form an angled shape together, which improves structural strength thereof. Moreover, the two first ribs 1101 are arranged in an imaginary line that is parallel with the first lateral surface 111, and the two second ribs 1102 are arranged in another imaginary line that is parallel with the second lateral surface 112.

The top cover 12 is mounted on the bottom casing 11. The top cover 12 is made of light transmission materials and is capable of scattering or diverging light beams.

The circuit board 13 is mounted in the bottom casing 11 and located between the top cover 12 and the bottom casing 11. The circuit board 13 has an illumination component 131 and a plurality of sockets 132. In this embodiment, the illumination component 131 may be a light emitting diode (LED) and is capable of emitting light beams in various colors. Furthermore, the illumination component 131 is operated by a specific chip. In another embodiment, the circuit board 13 may have multiple illumination components 131 and multiple chips, and each illumination component 131 is controlled by a respective one of the chips. The divergent component 14 is mounted on the illumination component 131. Further, with the top cover 12, the light beams emitted from the illumination component 131 are scattered, and thereby it looks like the light beams are emitted from the top cover 12 evenly.

The sockets 132 are mounted on the bottom surface 110. In this embodiment, the circuit board 13 has six sockets 132 and the number is corresponding to the number of the lateral surfaces, but it is not limited thereto. Each one of the sockets 132 is arranged in a direction perpendicular to a respective one of the lateral surfaces. In other words, the sockets 132 are facing laterally and outward. However, it is not limited thereto; in another embodiment, the sockets 132 may be arranged in a direction parallel with the lateral surfaces. In this embodiment, each one of the sockets 132 is a type-C female port; in another embodiment, the ports may be in any other configuration, it is not limited thereto.

As shown in FIG. 1, adjacent two of the illumination assemblies 10 are connected by one of the bendable connectors 20 and fixed by one of the fixing components 30.

Figure 6:
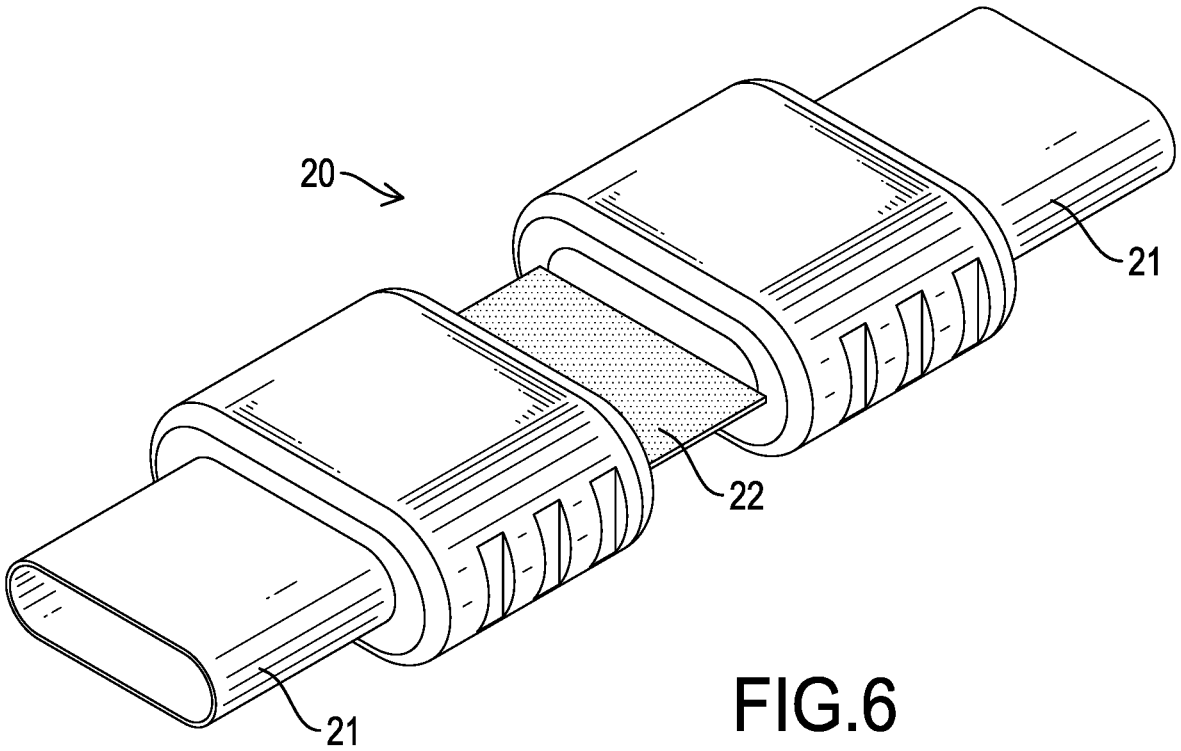
FIG. 6 is a perspective view of a bendable connector of the styling illumination set in FIG. 1.
Figure 7:
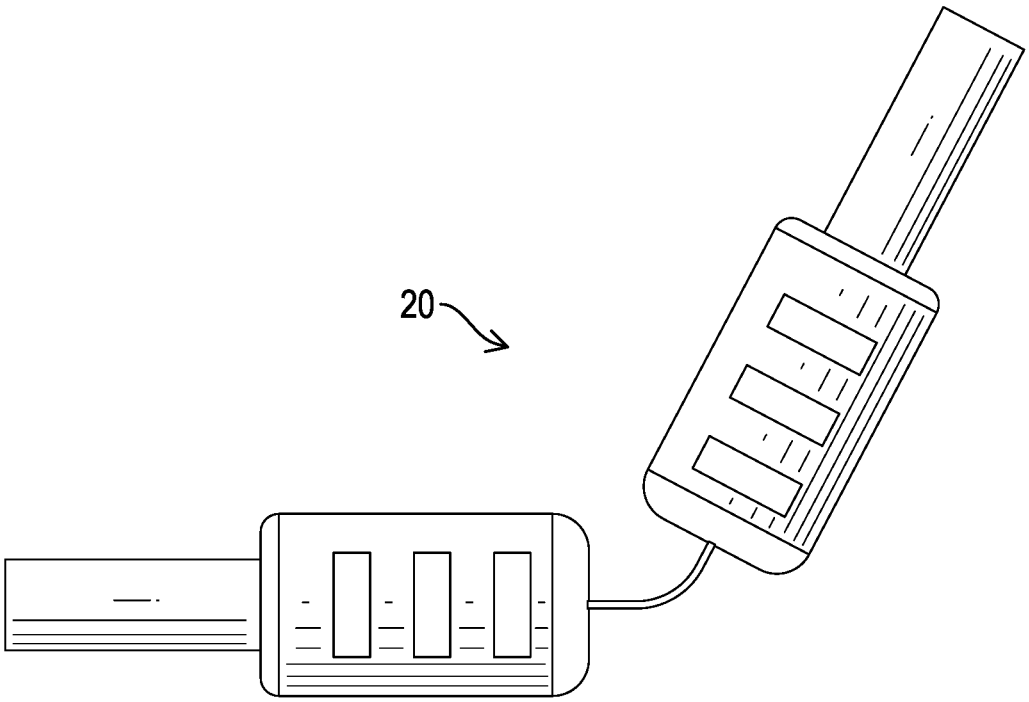
FIG. 7 is a side elevation view of the bendable connector in FIG. 6, showing the bendable connector being bent.
Figure 8:
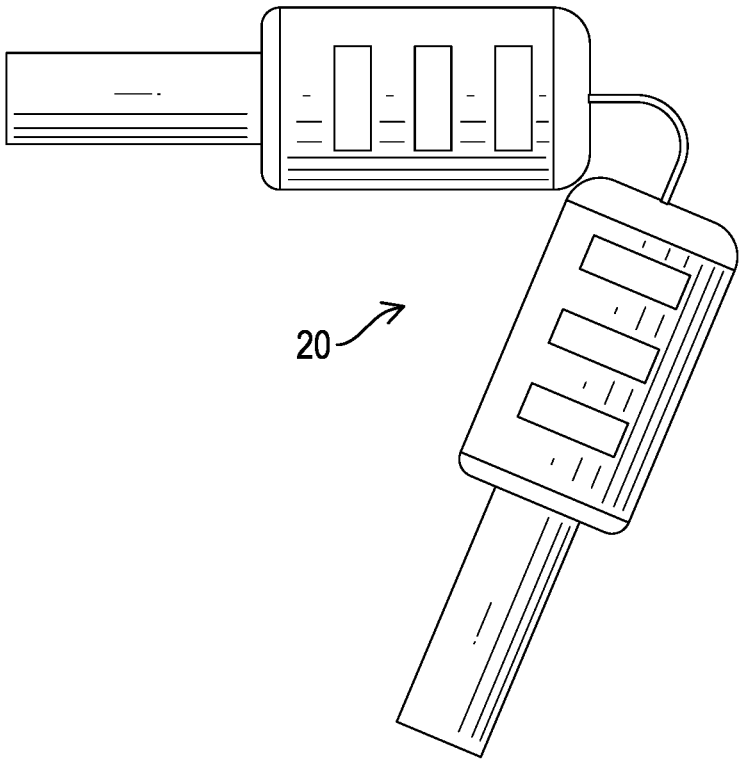
FIG. 8 is another side elevation view of the bendable connector in FIG. 6, showing the bendable connector being bent in another angle.
Figure 9:
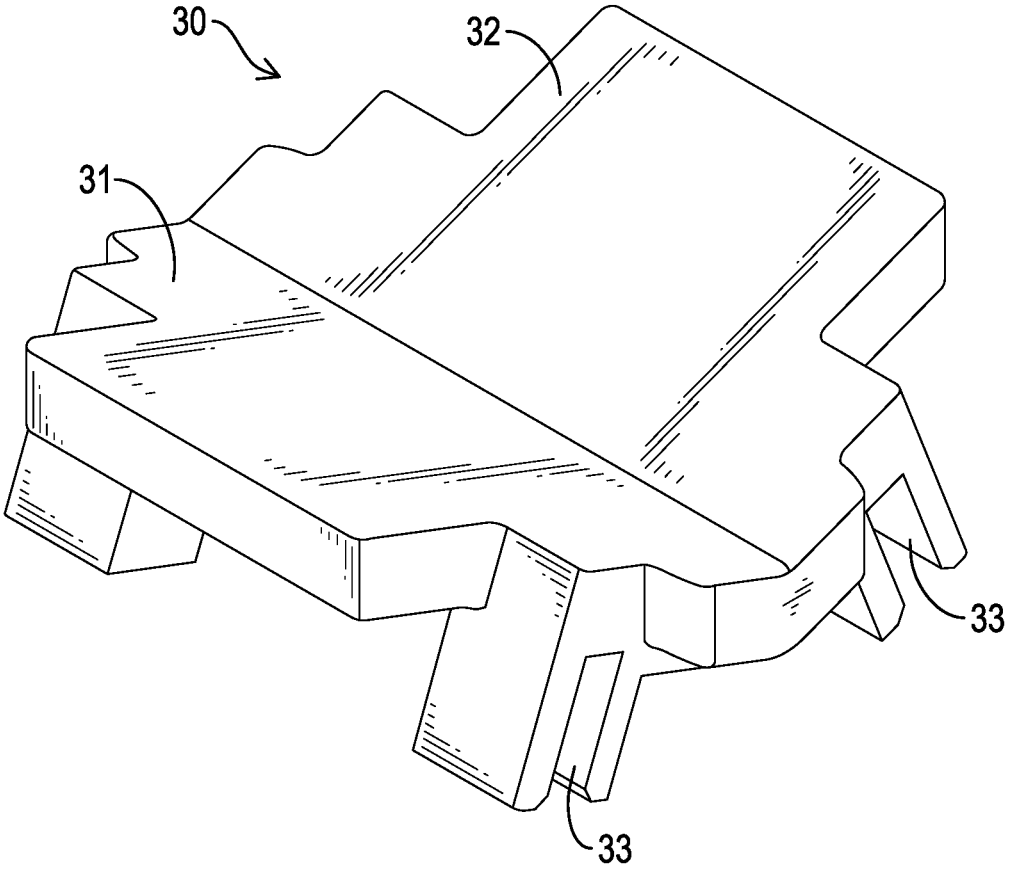
FIG. 9 is a perspective view of a fixing component of the styling illumination set in FIG. 1.
Figure 10:
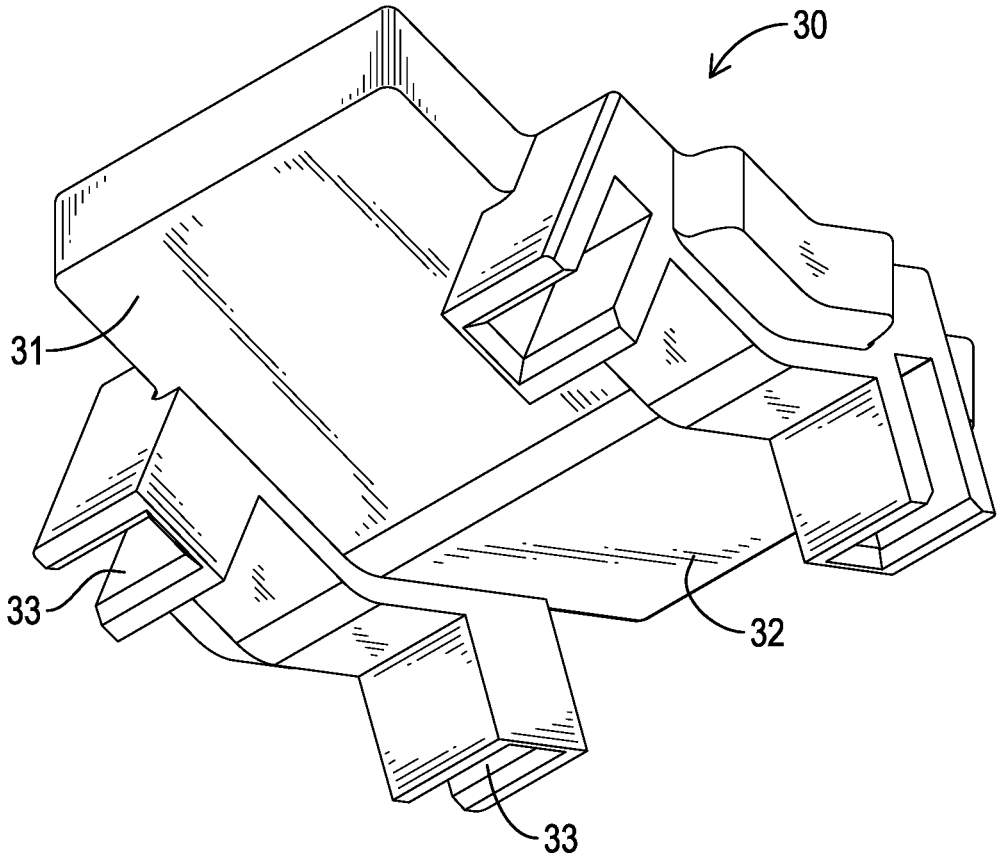
FIG. 10 is another perspective view of the fixing component in FIG. 9.
Figure 11:
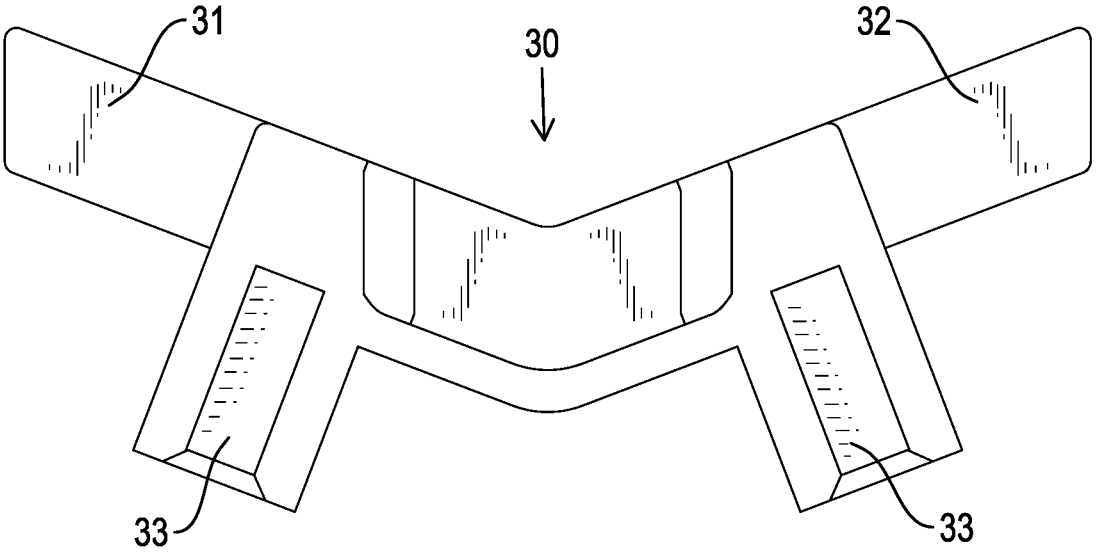
FIG. 11 is a side elevation view of the bendable connector in FIG. 9.

Please refer to FIG. 6 to FIG. 8. Each one of the bendable connectors 20 comprises two plugs 21 and a bendable band 22. Two ends of the bendable band 22 are connected to the two plugs 21 respectively. After being bent, the bendable band 22 can keep the curve if no external force exerts on the bendable band 22. One of the plugs 21 is detachably inserted in one of the sockets 132 of one of the adjacent two illumination assemblies 10, and the other one of the plugs 21 is inserted in one of the sockets 132 of the other one of the adjacent two illumination assemblies 10. Therefore, power and signals can be transmitted between the adjacent two illumination assemblies 10. Besides, with the bendable band 22, an angle between the adjacent two illumination assemblies 10 is adjustable. In this embodiment, each one of the plugs 21 is a type-C male port. Precisely, the bendable connectors 20 may be made from flexible printed circuit board (a.k.a. FPC).

Please refer to FIG. 9 to FIG. 11 and FIG. 17. With the fixing components 30, the angle between the adjacent two illumination assemblies 10 is secured and cannot be adjusted. Each one of the fixing components 30 comprises a first board 31, a second board 32, and a plurality of engaging structures 33. The first board 31 and the second board 32 are connected with each other and form an angled shape. The first board 31 is configured to abut the bottom surface 110 of one of the adjacent two illumination assemblies 10 and the second board 32 is configured to abut the bottom surface 110 of the other one of the adjacent two illumination assemblies 10.

The engaging structures 33 are mounted on the first board 31 and the second board 32 respectively. In this embodiment, the number of the engaging structures 33 is four. Two of the engaging structures 33 are mounted on the first board 31 to engage with the two first ribs 1101 of one of the adjacent two illumination assemblies 10, and the remaining two of the engaging structures 33 are mounted on the second board 32 to engage with the two first ribs 1101 of the other one of the adjacent two illumination assemblies 10. Therefore, the adjacent two illumination assemblies 10 are fixed with the engaging structure 33 and the angle between the adjacent two illumination assemblies 10 is secured. In another embodiment, if the bendable connectors 20 can keep the angle by itself, the illumination device may not have the fixing components 30.

Please refer to FIG. 1 and FIG. 12 to FIG. 14. The controller 40 may be a single-chip microcomputer controller, which is connected to the illumination assemblies 10 via a wire or wireless method. The controller 40 is configured to recognize an order of the illumination assemblies 10. The controller 40 is capable of receiving an external wireless signal and then transmits the external signal to the illumination assemblies 10. With the controller 40, the illumination assemblies 10 are capable of being controlled individually. In other words, the user can select the color, brightness, flicker mode, etc. of each illumination assembly 10. The controller 40 may comprise a switch, a button, or a knob, such that the controller 40 is capable of controlling the illumination assemblies 10.

An illumination device is provided in accordance with the present invention. The illumination device may only have one aforesaid illumination assembly 10 or have multiple illumination assemblies 10 connected together. If multiple said illumination devices are connected to the bendable connectors 20, power and signals are transmitted between said illumination devices via the bendable connectors 20. Each one of the bendable connectors 20 includes multiple type-C male ports 21; said two illumination devices are fixed via a fixing component 30, said fixing component 30 forms an angled shape such that two of said illumination devices are secured in a non-planar arrangement, which is similar to the aforesaid styling illumination set. One of the differences between the illumination device and the styling illumination set may be that: the styling illumination set only have one controller 40 but the illumination device has multiple controllers 40 to control each illumination device.

Figure 15:
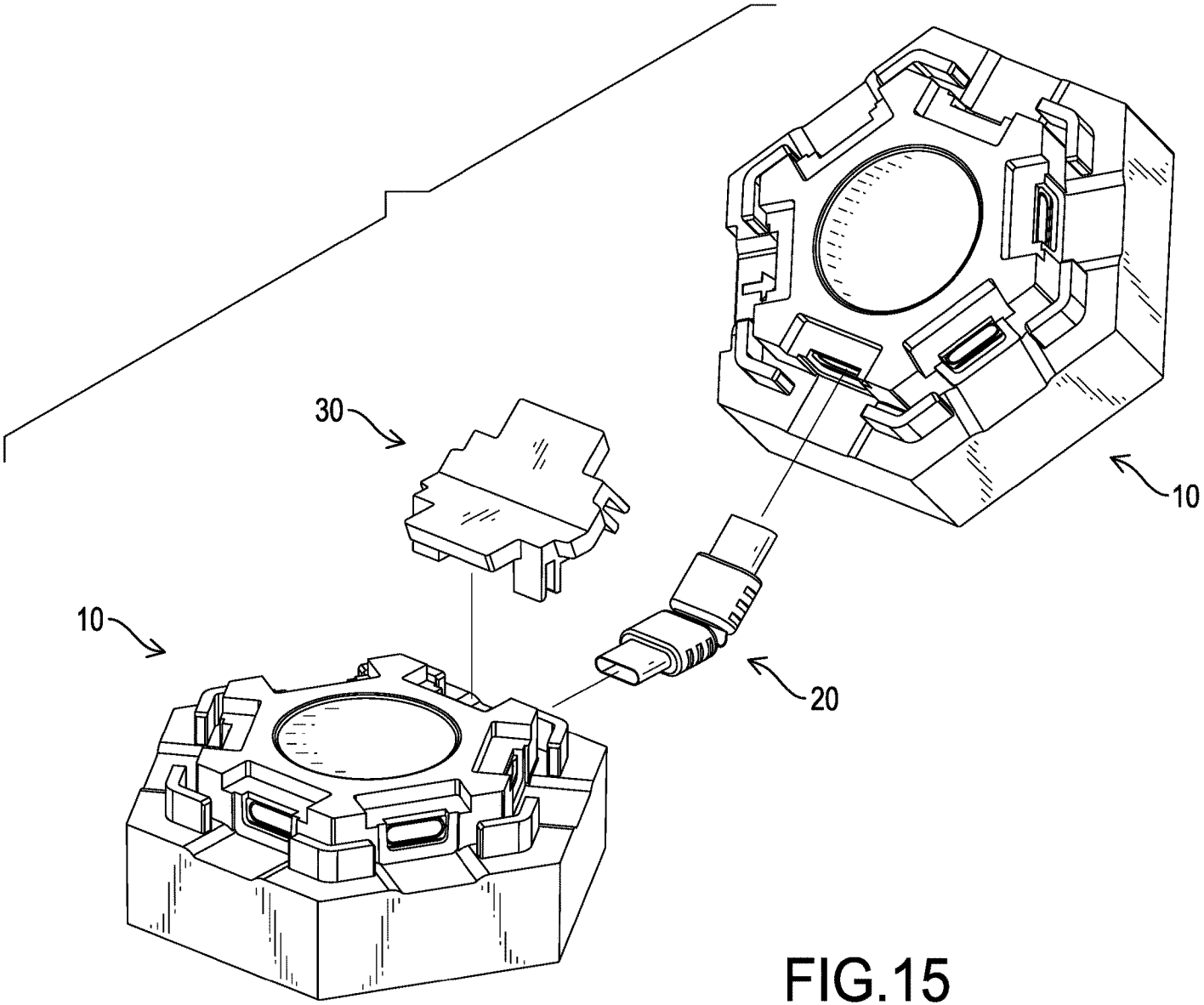
FIGS. 15 and 16 are perspective views of assembling two illumination assemblies in FIG. 1.
Figure 16:
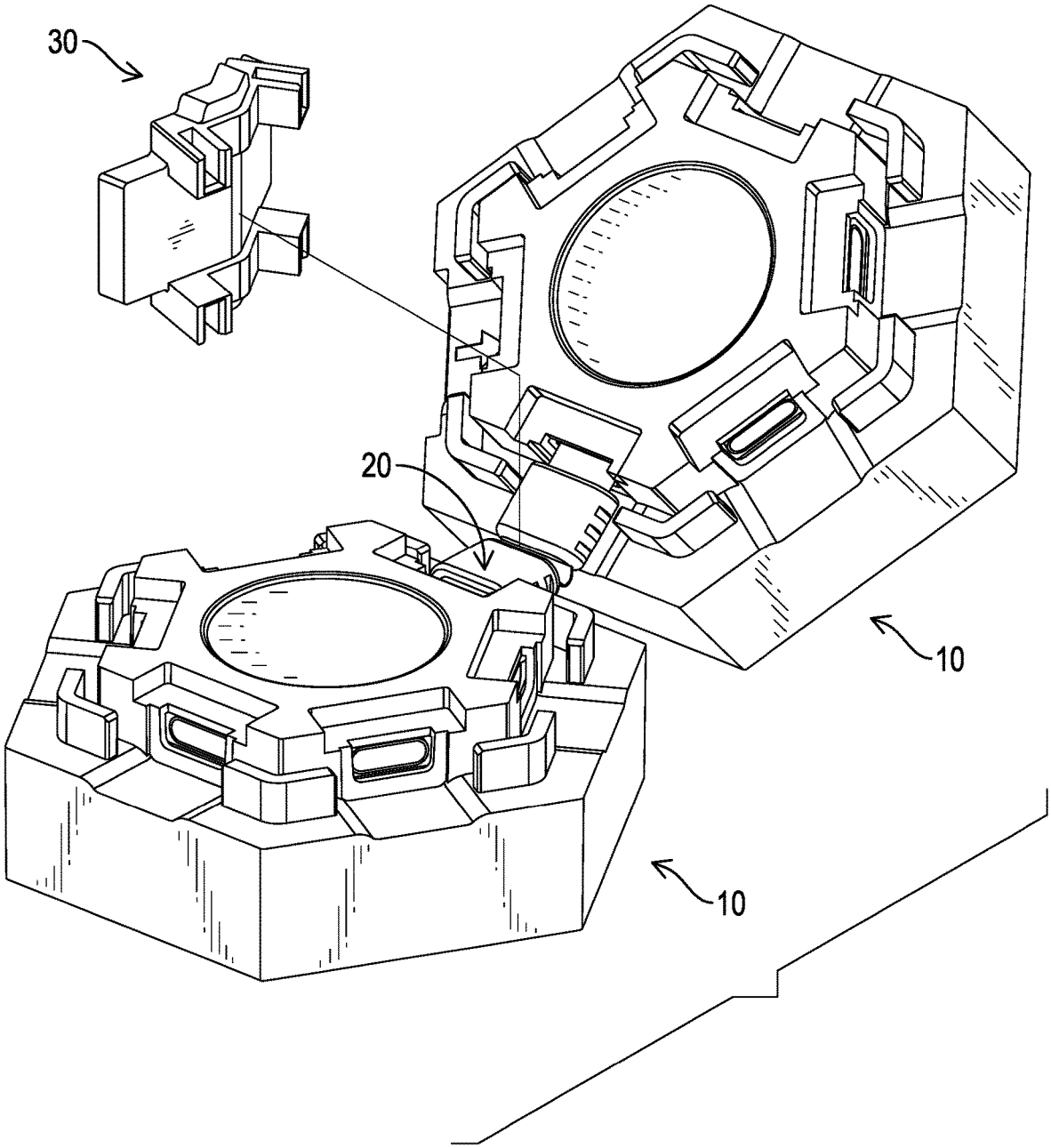
Figure 17:
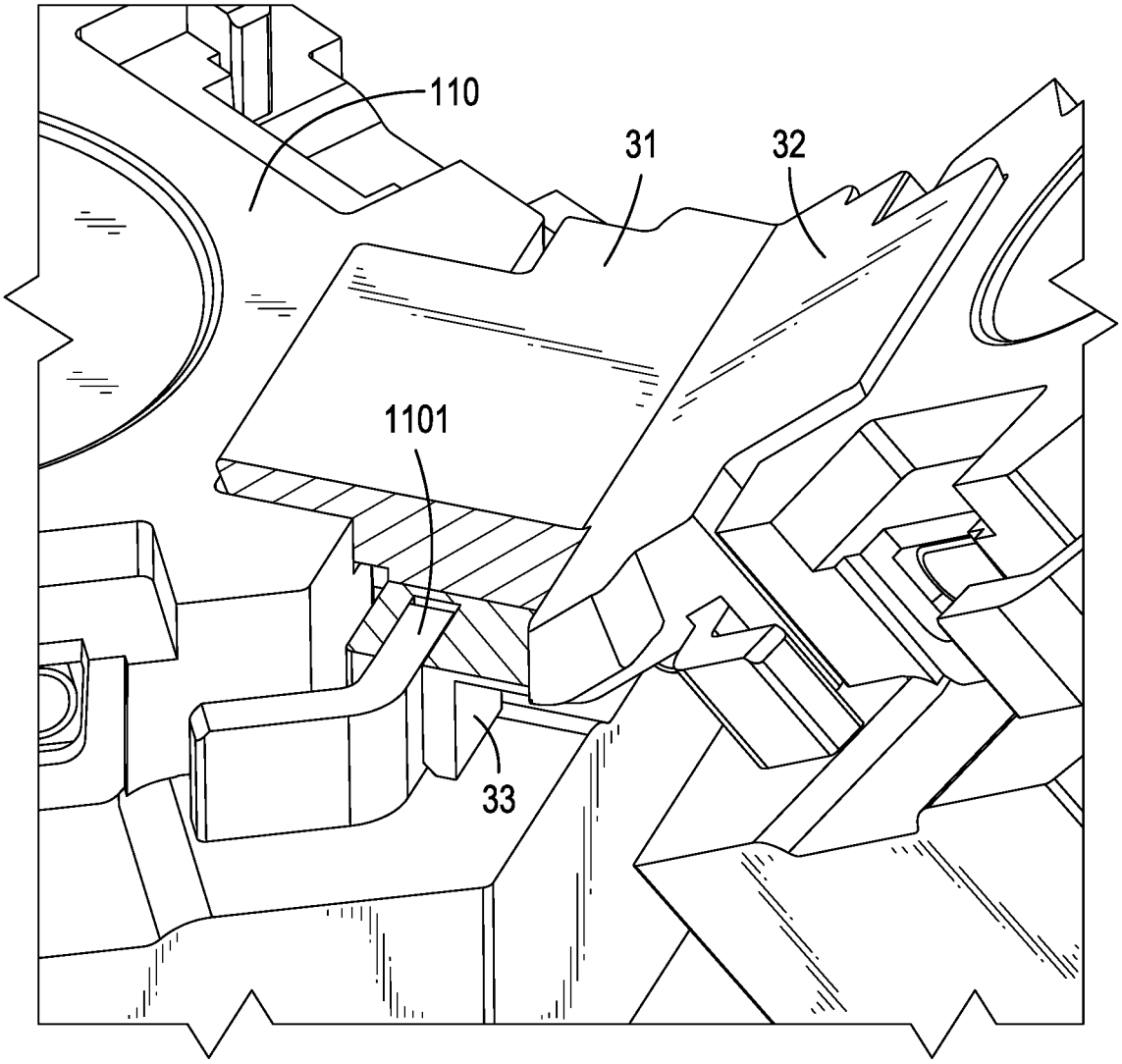
FIG. 17 is a partial sectional view of assembling two illumination assemblies in FIG. 1.

Then please refer to FIG. 15 to FIG. 17. Consequently, with the illumination assembly 10 having multiple sockets 132/type-C female ports, multiple illumination devices can be connected together in various configurations or the styling illumination set can be installed in various configurations, e.g. a ball shape as shown in FIG. 1. Precisely, in the styling illumination set, the bendable connector 20 can be bent in any angle, so the angle between the illumination assemblies 10 connected to the bendable connector 20 can be changed as well. Then, the fixing component 30 can fix the illumination assemblies 10 in a desired angle. Moreover, with the bendable connector 20 and the fixing component 30, the configurations are not restrained in two dimensions, but can be built up in three dimensions, which allows the present invention to be arranged in more unique configurations.

Besides, with the bendable connectors 20 connecting multiple illumination assemblies 10, power is capable of transmit to every illumination assembly 10 with enough voltage. Further, as long as the styling illumination set and other product (e.g. an illumination light strip, an illumination light wire, an illumination hose, an illumination tube light, etc.) have the same port, the styling illumination set and these products can be connected by the bendable connector 20 for transmitting power and signals.

As a result, with the aforementioned structures, the illumination device can be connected via the same ports, e.g. type-C port. Furthermore, if a new product comprises a compatible circuit board or chip and the same ports, the new product can be connect to the illumination device as the present invention. Therefore, the illumination device as the present invention is upward compatible with future products.

Besides, the illumination device can be used with a string light (not shown in the drawings). The string light may have two ends. A male port is mounted on one of the ends of the string light and a female port is mounted on the other. The male port of the string light can be inserted into the female port of the illumination device of the present invention and thus signals can be transmitted between the string light and the illumination device. If the female port of the string light need to be connected to the illumination device, an adapter (e.g. a double male port connector) may be a bridge.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An illumination device comprising:
an illumination assembly comprising:
a bottom casing comprising:
a bottom surface;
a first lateral surface connected to the bottom surface;
at least one first rib mounted on the bottom surface and adjacent to the first lateral surface;
a second lateral surface connected to the bottom surface and the first lateral surface; and
at least one second rib mounted on the bottom surface and adjacent to the second lateral surface;
a top cover mounted on the bottom casing; and
an illumination circuit board mounted in the bottom casing and between the top cover and the bottom casing; and
a plurality of female ports mounted on the bottom surface of the bottom casing and facing laterally and outward;
wherein a plurality of the illumination devices are configured to be connected by a plurality of connectors, power and signals are transmitted between said illumination devices via the connectors, each one of the connectors including multiple male ports; said two illumination devices are fixed via a fixing component, said fixing component forms an angled shape such that two of said illumination devices are secured in a non-planar arrangement.

2. An illumination device comprising an illumination assembly and the illumination assembly comprising:
a bottom casing comprising:
a bottom surface;
a first lateral surface connected to the bottom surface;
at least one first rib mounted on the bottom surface and adjacent to the first lateral surface;
a second lateral surface connected to the bottom surface and the first lateral surface; and
at least one second rib mounted on the bottom surface and adjacent to the second lateral surface;
a top cover mounted on the bottom casing; and
a circuit board mounted in the bottom casing and between the top cover and the bottom casing; the circuit board having:
an illumination component; and
a plurality of sockets mounted on the bottom surface.

3. The illumination device as claimed in claim 2, wherein the bottom casing is a polygon.

4. The illumination device as claimed in claim 3, wherein the bottom casing is a triangle, quadrilateral, pentagon, hexagon, or octagon.

5. The illumination device as claimed in claim 2, wherein:
the at least one first rib includes two said first ribs; and
the at least one second rib includes two said second ribs, one of the two second ribs connect to one of the two first ribs.

6. The illumination device as claimed in claim 2 further comprising a divergent component mounted on the illumination component.

7. A styling illumination set comprising:
a plurality of illumination assemblies, each one of the illumination assemblies comprising:

a bottom casing comprising:

a bottom surface;

a first lateral surface connected to the bottom surface;

at least one first rib mounted on the bottom surface and adjacent to the first lateral surface;

a second lateral surface connected to the bottom surface and the first lateral surface; and at least one second rib mounted on the bottom surface and adjacent to the second lateral surface;

a top cover mounted on the bottom casing;

a circuit board mounted in the bottom casing and between the top cover and the bottom casing; the circuit board having:

an illumination component; and a plurality of sockets formed on the bottom surface of the bottom casing; and a plurality of bendable connectors, adjacent two of the illumination assemblies connected by one of the bendable connectors;

a plurality of fixing components, the adjacent two of the illumination assemblies fixed by one of the fixing components and thereby an angle between the adjacent two illumination assemblies being secured.

8. The styling illumination set as claimed in claim 7, wherein the illumination assemblies are capable of being controlled individually.

9. The styling illumination set as claimed in claim 7 further comprising a controller configured to recognize an order of the illumination assemblies.

10. The styling illumination set as claimed in claim 9, wherein the controller is capable of receiving an external wireless signal and then transmits the external wireless signal to the illumination assemblies.

11. The styling illumination set as claimed in claim 7, wherein each one of the bendable connectors comprises:

two plugs, one of the plugs detachably inserted in one of the sockets of one of the adjacent two illumination assemblies, and the other one of the plugs inserted in one of the sockets of the other one of the adjacent two illumination assemblies;

a bendable band, two ends of the bendable band connected to the two plugs respectively.

12. The styling illumination set as claimed in claim 7, wherein:

the at least one first rib extends parallel with the first lateral surface; and the at least one second rib extends parallel with the second lateral surface.

13. The styling illumination set as claimed in claim 7, wherein:

the at least one first rib includes two said first ribs; and the at least one second rib includes two said second ribs, one of the two second ribs connected to one of the two first ribs.

14. The styling illumination set as claimed in claim 13, wherein:

the two first ribs are arranged in an imaginary line and the imaginary line is parallel with the first lateral surface; and the two second ribs are arranged in another imaginary line and said another imaginary line is parallel with the second lateral surface.

15. The styling illumination set as claimed in claim 7, wherein each one of the fixing components comprises:

a first board configured to abut the bottom surface of one of the adjacent two illumination assemblies;

a second board connected to the first board and configured to abut the bottom surface of the other one of the adjacent two illumination assemblies; and a plurality of engaging structures, at least one of the engaging structures mounted on the first board and configured to engage with the at least one first rib of said one of the adjacent two illumination assemblies, at least one of the engaging structures mounted on the second board and configured to engage with the at least one first rib of said other one of the adjacent two illumination assemblies.

16. The styling illumination set as claimed in claim 7, wherein each one of the illumination assemblies further comprises a divergent component mounted on the illumination component.

* * * * *